United States Patent [19]

Lefebvre

[11] 4,261,542

[45] Apr. 14, 1981

[54] IMPROVEMENTS IN RETRACTILE TUNNEL FORMS FOR POURED CONCRETE

[75] Inventor: Louis Lefebvre, Saint-Amand-les-Eaux, France

[73] Assignee: Outinord-St.-Amand, S.A., France

[21] Appl. No.: 60,200

[22] Filed: Jul. 24, 1979

[30] Foreign Application Priority Data

Jul. 25, 1978 [FR] France ..... 78 22894

[51] Int. Cl.[3] ..... B28B 7/02; B29C 1/00

[52] U.S. Cl. ..... 249/11; 405/150; 425/59; 425/62

[58] Field of Search ..... 249/10–12; 425/59, 62; 405/150, 146, 151; 16/44

[56] References Cited

U.S. PATENT DOCUMENTS

| | | | |
|---|---|---|---|
| 7,549 | 3/1877 | Johnson | 301/2 |
| 175,999 | 4/1876 | Johnson | 301/2 |
| 349,593 | 9/1886 | Johnson | 301/2 |
| 454,085 | 6/1891 | Swan | 301/2 |
| 958,548 | 5/1910 | Sapp | 301/2 |
| 2,486,801 | 11/1949 | Sarosdy | 249/10 |
| 3,645,210 | 2/1972 | Tanaka | 301/2 |
| 3,678,693 | 7/1972 | Markewitz et al. | 249/11 |
| 3,693,927 | 9/1972 | Jennings | 249/11 |
| 3,696,177 | 10/1972 | Holland | 249/11 |
| 4,142,705 | 3/1979 | Miller | 249/11 |

FOREIGN PATENT DOCUMENTS

| | | | |
|---|---|---|---|
| 2710447 | 9/1978 | Fed. Rep. of Germany | 405/150 |
| 979373 | 4/1951 | France | 301/2 |
| 1086408 | 2/1955 | France | 16/44 |
| 166910 | 3/1950 | Netherlands | 249/11 |

*Primary Examiner*—W. E. Hoag

*Attorney, Agent, or Firm*—Frailey & Ratner

[57] ABSTRACT

This invention relates to U-shaped tunnel-type forms for poured concrete having an upper horizontal panel resting on two spaced vertical sides which, in turn, are separated on the ground by a combination of jacks and wheels. The bottom portions of the two sides are connected by plural horizontal retractile tie beams. The upper horizontsl panel is supported by articulated horizontal beams pivotal at their ends and in the middle to permit the panel to be deformed by curving it downward, thereby pulling toward each other the spaced corners or edges of the dihedrons formed by the junctures of the spaced vertical sides and the horizontal panel. The improved form or coffering is characterized by the combination of plural articulated supporting beams for the horizontal panel supported by lengthwise adjustable inclined braces, axles having capacity for axial displacement relative to their wheels, but which are retractable automatically back to their median position by springs disposed on each side of the wheels, and lengthwise adjustable horizontal tie beams connecting the lower portions of the sides of the structure.

12 Claims, 13 Drawing Figures

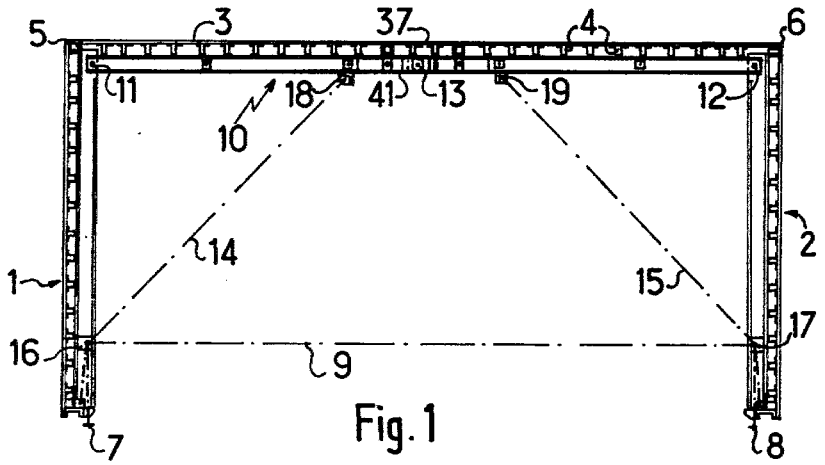
Fig. 1
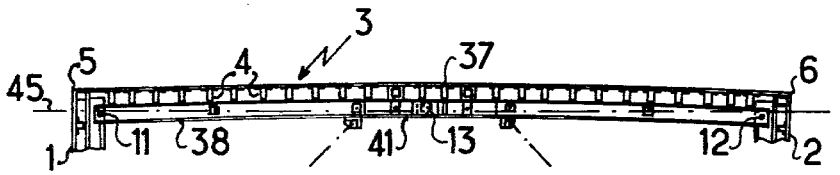
Fig. 2
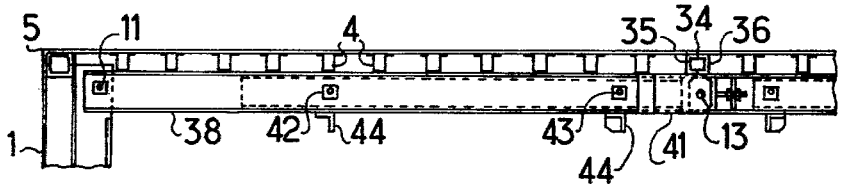
Fig. 3
Fig. 4
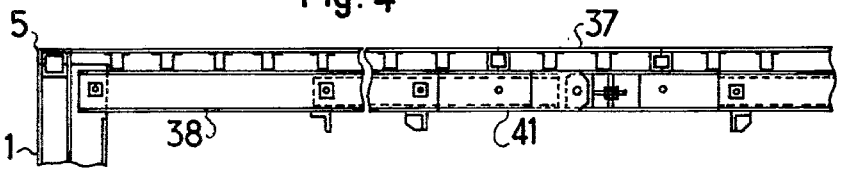

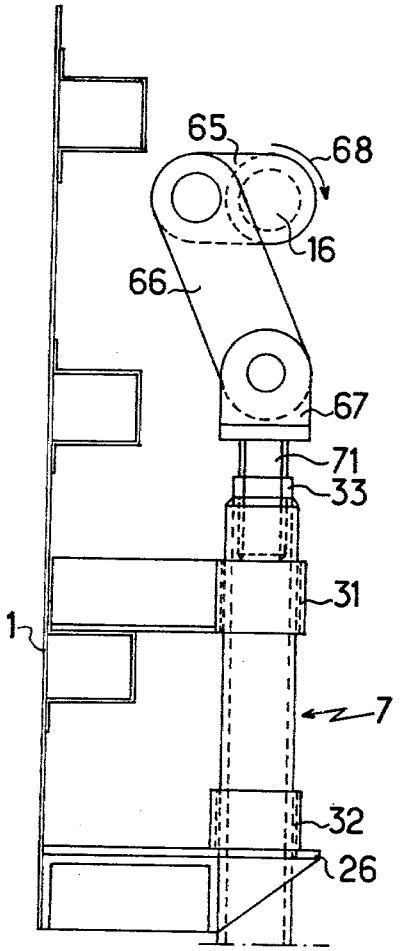
Fig. 8
Fig. 9
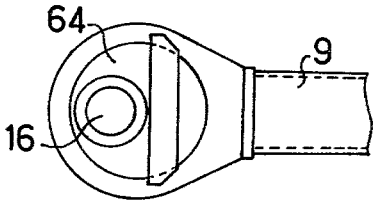
Fig. 10
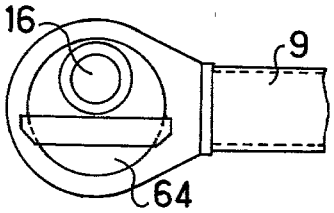

Fig. 11
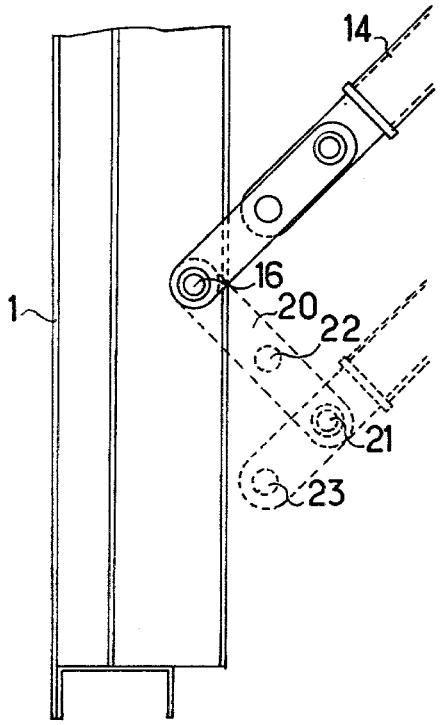
Fig. 12
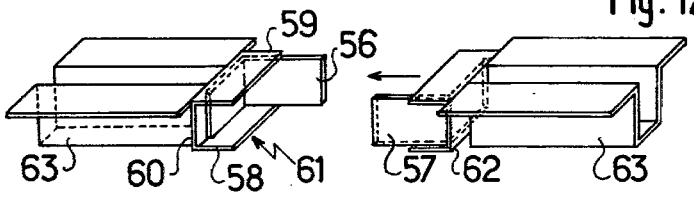
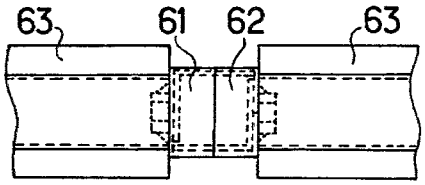
Fig. 13

IMPROVEMENTS IN RETRACTILE TUNNEL FORMS FOR POURED CONCRETE

BACKGROUND OF THE INVENTION

The present invention relates to improvements in retractile tunnel-shaped or tunnel-type framing or forms for poured concrete having two parallel vertical sides which cooperate with two other corresponding sides. The tops of the parallel sides are connected by a horizontal panel stiffened by omega-shaped sections which are parallel to the planes of the sides, but flexible only in the transverse direction, that is to say being deformable solely around axes which are parallel to the corners or edges of the dihedrons formed by the vertical sides and the horizontal panel. The sides rest on the ground by means of jacks, which ensure downward retractability, and wheels which support the form after it is lowered. The lower portions of the sides are connected by horizontal tie beams, with fine screw-type adjusting, which ensure the horizontal retractability of the bottom of the form. The horizontal panel is supported by articulated beams operable to deform said panel, curving it downward and moving inward the corners of the dihedrons to ensure horizontal retractability of the top of the coffering.

The main problem which the present invention undertakes to solve is to decrease the recurring cost of setting up tunnel-type cofferings or forms for concrete used in industrial construction. Frequent attempts have been made not only to lower the cost, but also to shorten the times of assembly, disassembly and handling. It is important, also, to lower the cost of maintenance by means of a suitable simplification.

Existing U-shaped tunnel-type cofferings, that is to say framing or cofferings which are used to form concrete into two lateral walls and a ceiling, may be divided into two large groups. The first group, which has been used for many years, is the two half-shell type coffering. These cofferings are described in French Pat. No. 1,180,699 dated June 17, 1957, and in its addition No. 73,650 dated May 29, 1958. Improvements are described in French Pat. No. 2,136,400 dated Apr. 11, 1972, and especially in French Pat. No. 2,256,671 dated July 15, 1975, and in its first addition No. 74.39448 dated Dec. 3, 1974. Those latter two patents disclose improvements which made it possible to accelerate the handling and use of cofferings of the two half-shell type. The present invention provides for devices which make possible a similar acceleration in the second group of cofferings which now is going to be discussed.

The second group of tunnel-type cofferings is the one called "retractile cofferings", that is to say forms or framing in which the horizontal panel is made of a single part and can be deformed by curving downward, to bring the two corners of the dihedrons formed by the horizontal panel and the vertical sides closer together. Those cofferings are described in French Pat. No. 1,512,440 dated Dec. 23, 1966, and in its addition No. 95,181 dated June 17, 1968, as well as in French Pat. No. 1,600,108 dated Dec. 30, 1968 and its addition No. 2,079,546 dated Feb. 4, 1970. That type of coffering makes it possible, in addition to permitting the concrete to set rapidly, to quickly decoffer or disassemble the pouring construction, and to move the coffering en masse while maintaining the horizontal panel in a single piece, that is to say eliminating the risk of uneven molding in the center of the poured concrete. The mechanics of maneuvering those cofferings, however, is rather complicated, and another purpose of the present invention is to simplify it. Further, the time for handling those cofferings was long, and a third purpose of the present invention is to accelerate such handling and make it more dependable and more rational.

Another drawback of existing retractile cofferings is in not being able to provide an upwardly concave bend in the ceiling which is being formed by pouring concrete. That is a drawback which the present invention eliminates.

SUMMARY OF THE INVENTION

The present invention is characterized essentially by the combination:

of supporting beams for the horizontal panel which are articulated at their mid-points and supported by braces of adjustable length, the useful length of which can be set at a maximum (coffering or setting up operation) and at a minimum (decoffering or removal operation), said braces being connected to the bottom portions of the sides and close to the middle articulation points of the horizontal supporting beams, of axles which are slidable axially relative to their wheels, but which are retractable to a middle position by elastic means, of adjustment means, particularly supporting beams for the horizontal panel and tie beams.

The displacement of the axles relative to their wheels makes possible an easier adjustment of the tie beams when the coffering rests on the wheels at the time when the side supporting jacks are raised. That is the reason for the axial displacement of the axles with an amplitude which is approximately twice the linear stroke of the horizontal tie beams. Springs on each side of each wheel hold each axle in a median position. It is possible to use, to that end, two helical springs mounted on the shaft on each side of the wheel, or also two leaf springs. Furthermore, and as a step toward simplification of the construction, each wheel is placed inside a casing which also contains a supporting jack for the sides.

One essential characteristic of the invention resides in the fact that the beams supporting the horizontal panel have their articulation points in alignment when the panel is slightly upwardly convex. Thus, when the panel is rigorously planar, the middle articulation has its axis located below the plane of the two end axes. This presents the advantage of making possible the casting of a ceiling with a slightly upwardly concave curve while ensuring the retractability of the horizontal panel, even at the beginning of the bending of the panel supporting beams.

To adjust the size of the horizontal panel, the supporting beams for the horizontal panel are extensible in a discontinuous manner, and the horizontal panel is slit in the middle to be of two separable parts between which it is possible to place a complementary rectangular panel of a desired width. The desired width corresponds to the lengthening of the two parts of the supporting beams, which mount means for limiting the desired length. To carry out the above, each half of each panel supporting beam is composed of two small beams held separated and parallel by means of small bars, to provide a space inside which there can slide a thid small beam which is joined to the two others, at the desired lengths, by means of pins traversing the three small beams through holes pierced at suitable locations.

There is thus realized a discontinuous adjusting of the width of the panels.

In addition, the panel supporting beams have a length which is adjustable in a continuous manner over a short distance by transverse displacement of the middle articulating pivot in enlongated slots under the action of a threaded stem tightener which moves relative to a hole in a small rib where it is anchored by a nut and lock nut arrangement.

According to a known technique, which is applied here to the deformable horizontal panel, the joining and levelling of two adjacent horizontal panel portions is done by means of positioning blocks placed perpendicular to the wings and to the core of U-shaped sections, the wings of which are placed parallel to the plane of the panel and turned toward the adjacent panel edges. The sections are welded at the ends of the omega-shaped sections, which terminate a short distance from the panel edges such that the edges of the wings of the U-shaped sections are flush with the adjacent panel edges. The blocks project from the adjacent edges of the panels by an amount slightly less than the depth of the U-shaped sections, to fit into the corresponding U-shaped section of the adjacent panel.

According to the preferred embodiment of the invention, the coffering or form defined above is characterized by the combination:

of braces made of two parts and maintained at their maximum length by a pin running through those two parts, of supporting jacks for the sides, of the conventional screw type, of horizontal tie beams having length adjusting means which makes it possible always to return them to the initial setting, of means for handling and adjusting the panel supporting beams, constituted by a central extensible stay supported at one end on the ground and at the other end close to the central articulation points of the horizontal beams supporting the horizontal panel.

According to the modification of the invention, the length of the braces, the displacement of the jacks which support the sides and the lengths of the tie beams connecting the lower portions of the sides are capable of undergoing simultaneous modifications by means of a central control system. In that case, the central control system includes a horizontal shaft placed near the lower part of one side and rotated by a motor means to simultaneously operate, during the extension (i.e. coffering) and contraction (i.e. decoffering) of the apparatus the horizontal tie beams at the bottoms of the sides, the jacks which support the sides on the ground, the braces, each one of those members having, in addition, means for adjusting its length initially and independently.

The initial and independent adjustment of the lengths of the tie beams, of the jacks and of the braces is done by forming those elements into two tubular parts which are screwed one inside the other.

The motor means is a hydraulic jack, but it also may be constituted by a reduction motor, for example.

The transformation of the rotational motion of the shaft into the linear motions of the other elements which are kinematically connected to it is done by any known means of transforming these motions one into the other, such as a cam system, a system with an eccentric or a connecting rod-crank system.

Other characteristics and advantages of the present invention will appear in the course of the following description, which will show various embodiments of the basic definitions which have been indicated above.

BRIEF DESCRIPTION OF THE FIGURES OF THE DRAWING

The attached drawing illustrates the description which follows, in which:

FIG. 1 is a schematic vertical section of the whole coffering, form or framing in which there have been omitted the details of its mechanical control.

FIG. 2 is a fragmentary view of the upper panel, similar to that of FIG. 1.

FIG. 3 is an enlarged detail of the left upper part of FIG. 2.

FIG. 4 is an enlarged detail of the left upper part of FIG. 2.

FIG. 8 is an enlarged elevational view of the lower part of the left side, including a supporting jack and the horizontal shaft of the central control.

FIGS. 9 and 10 illustrate two different positions of the eccentric which governs the length of the horizontal tie beams.

FIG. 11 is a fragmentary view in elevation of the device for varying the length of a brace, with immobilization by means of a pin.

FIG. 12 shows in perspective the structure to join and level two adjacent horizontal panel portions by means of positing blocks.

FIG. 13 is a modified view of FIG. 12 from underneath.

DETAILED DESCRIPTION OF THE INVENTION

Figure 5:
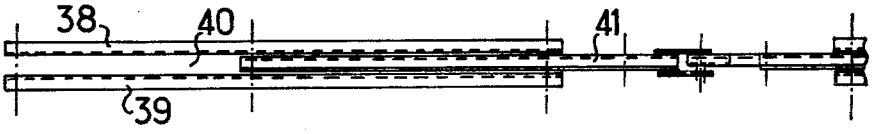
FIG. 5 is an enlarged plan view of one half of a supporting beam for the horizontal panel.

The coffering includes two spaced, vertical, parallel sides 1, 2, which cooperate with two other corresponding sides (not shown) in the pouring of concrete. The upper parts of sides 1 and 2 are connected by means of a horizontal panel 3 which is stiffened by omega-shaped sections 4 parallel to the planes of sides 1 and 2 and to the corners or edges 5 and 6 of the dihedrons formed by the horizontal panel 3 and the two sides 1 and 2. By means of that arrangement, the horizontal panel is flexible only for deformations in which the axes of curvature are parallel to edges 5 and 6. The sides 1 and 2 are supported on the ground during the concrete pouring operation by plural jacks 7 and 8, which provide retractability at the bottom of the coffering. Jacks 7 and 8 are supplemented by wheels 24 (FIG. 7) having horizontal shaft 25 perpendicular to the planes of sides 1 and 2, and which permit moving the whole coffering in a direction parallel to edges 5 and 6. The bottom portions of sides 1 and 2 are connected by horizontal tie beams 9, which ensure the horizontal retractability of the bottom of the coffering. The horizontal panel 3 is supported by articulated beams 10 which pivot at 11 and 12 in the upper ends of sides 1 and 2. Each beam 10 is articulated at its mid-point 13 so as to ensure the retractability of the upper part of the coffering, that is to say of the panel 3 which is deformable by undulating or curving in the downward direction.

All of those elements are known, when there are added to them mechanical devices for bending the beams 10.

The novelty of this invention resides in the control system for the bending of beams 10, combined with inclined tubular braces 14 and 15, which support beams 10 in two positions, namely in their position of maximum extension (coffering operation) and of minimum length (decoffering operation), and with wheels having axles which are moveable axially relative to the wheels, but which are retracted to their median position by elastic means. This latter particularly is required because of the variable lengths of the tie beams 9, to avoid causing the wheels to slide on the ground and expending too much energy in the extension and the shortening of the tie beams 9.

Braces 14 and 15 are not exceptional in themselves, relative to those disclosed in French Pat. No. 2,256,671. They are articulated to the lower portions of the sides 1, 2 at pivots 16 and 17, and also close to the median articulation 13 of beams 10 at pivots 18 and 19. The hollow braces 14, 15 are made of two threaded parts which screw one inside the other to provide fine adjustment. As shown in FIG. 11, close to articulation point 16 the brace 14 is interrupted to provide a small link 20 which is itself articulated to the brace 14 at pivot 21. Link 20 has a hole 22 which corresponds to hole 23 at the flattened end of the brace 14, so that it is possible to slide a pin (not shown) into the two holes 22 and 23, which can be extracted by a simple stroke with a hammer in order quickly to shorten the brace. That arrangement, also applicable to brace 15, is only an example, for it is possible to use other arrangements disclosed in French Pat. No. 2,256,671.

Another variation consists in replacing the pivots 16 or 17 by a horizontal shaft which is disposed close to, and extends along, the bottom of either side 1 or 2, and which may be driven by a motor (not shown) of any suitable type. The motor may be, for example, a reduction motor, or a jack such as a hydraulic jack, which operates a crank handle connected to shaft 16 (FIGS. 1, 8, 9, 10, 11) by a small connecting rod, or even connected directly thereto, or any other suitable drive means.

Figure 7:
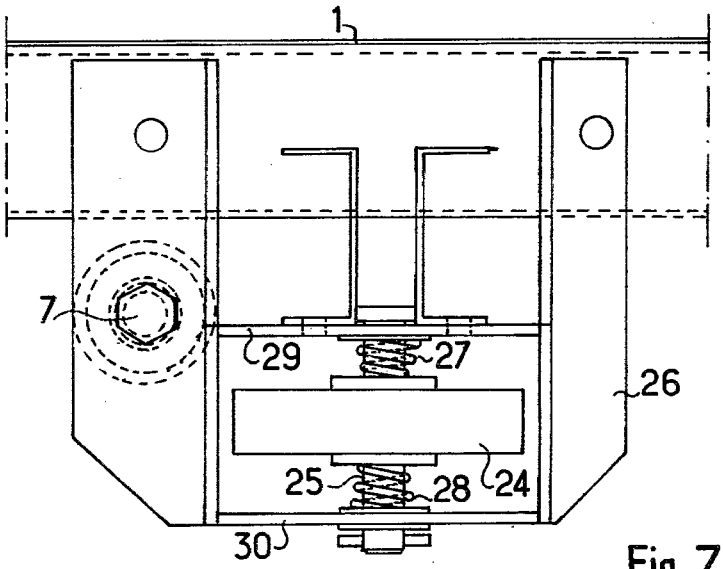
FIG. 7 is an enlarged plan view of a casing containing a wheel and a jack which support the sides.

Referring to FIG. 7, it will be seen that the wheels 24 are mounted on axles 25 inside casings 26 affixed to the lower inside portions of sides 1 or 2. Each axle 25 can move axially relative to its wheel 24 over a distance which is on the order of twice the linear stroke of tie beams 9. The axles 25 are retracted to the middle of wheels 24 by two helical springs 27 and 28 wedged between the wheels 24 and the side plates 29 and 30 of the casings 26. It is possible, also, to use leaf springs which act on each side of the wheels. Thus, when the coffering is resting on wheels 24 and the tie beams 9 are shortened, the sides 1 and 2 advance closer to wheels 24, moving axles 25 inward and compressing springs 27. Conversely, when the coffering rests on wheels 24 and the tie beams 9 are extended, the sides 1 and 2 are caused to move away from each other, moving axles 25 outward and compressing springs 28. The shortening or lengthening of the tie beams 9, therefore, results in the compression of either springs 27 or springs 28, but prevents any skidding of the wheels 24 on the ground. As soon as sides 1 and 2 are raised by means of jacks 7 and 8, axles 25 assume their median positions relative to their wheels 24 under the action of springs 27 and 28.

In a variation which simplifies the construction, casings 26 include, in addition to wheels 24, the jacks 7 and 8 which slide in guides 31 and 32 (FIG. 8). The jacks may be adjusted in height because, as illustrated by jack 7 in FIG. 8, the jacks are made of two threadingly connected tubular parts 7 and 71. The locking of those two parts is achieved by means of a lock-nut 33.

The horizontal panel 3 is connected to the articulated beams 10 by means of sliding guides provided with clamps (not shown). During normal use of that panel, the omega-shaped sections 4 bear against beams 10. When beams 10 are made to bend downwardly, by causing them to pivot on their articulations 11, 12, 13, panel 3 is pulled downward and undulates, due to the clamps. Panel 3 may be made of two parts separated at the center along a juncture 34 (FIG. 3), which is parallel to edges 5 and 6. At the juncture 34, there are provided two opposing U-shaped edges 35, 36, which include conventional positioning blocks, as described in the aforesaid patents and in French Pat. No. 1,369,466 dated July 2, 1963. The connection is completed by bolting the two sections 35 and 36 together.

The width of panel 3 may be increased by separating the two half-panels at the juncture 34 and placing between them a complementary panel 37 (FIGS. 1, 2 and 4) which is joined to the two half panels in the same manner as that explained above in respect to juncture 34. To accomplish that, it is necessary for the supporting beams 10 of the horizontal panel 3 to be extensible in a discontinuous manner. To that end, each half of each beam 10 (FIGS. 3, 5) is composed of two small beams 38, 39 maintained separated and parallel by small bars 44, to provide a space 40 inside which there can slide a third small beam 41 which is joined to the other two small beams 38, 39, at the desired lengths, by pins or bolts 42, 43 which pass through holes in the three small beams 38, 39, 41 at suitable locations.

An important characteristic of the invention resides in the fact that the three articulation axes or pivots 11, 12 and 13 are in the same plane (FIG. 2, dash-dot line 45) when the panel 3 is slightly convex in the upward direction. Thus, when panel 3 is rigorously planar or flat, the middle articulation 13 has its axis located below the plane of its two end axes 11 and 12. Due to that arrangement, when the beams 10 bend downwardly, the two articulation points 11 and 12 always move closer together. They thus ensure the retractile property of the upper part of the coffering. If this were not the case, when it would be desired to give an upward concave curve to panel 3, it would be impossible to decoffer, i.e. remove the form or framework, without causing a slight separation of axes 11 and 12 and consequent damage to the construction.

Figure 6:
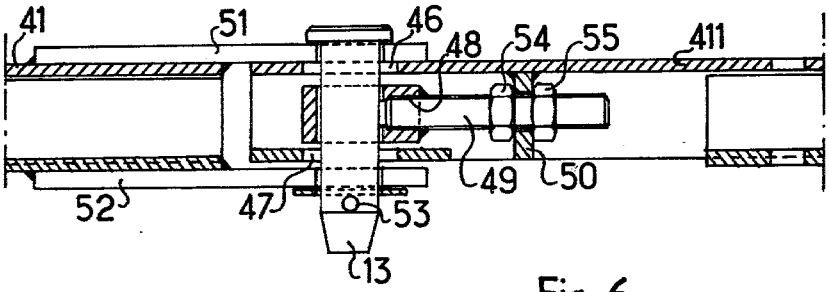
FIG. 6 illustrates in enlarged plan the detail of the central articulation of the supporting beam of FIG. 5, with a tension device.

Beams 10 further have a structure which makes it possible to ensure the tension on panel 3. This is achieved (FIG. 6) by transverse displacement of the middle articulation pivot or axis 13 in elongated openings 46 and 47 provided in a small beam 411 by a tightener 48 having a threaded stem 49 engageable within a rib 50 welded to the small beam 411. Articulation 13 is constituted by a pivot shaft passing through a frame 51, 52 and held by a pin 53. The displacement of threaded stem 49 is accomplished by means of a nut 54 and lock-nut 55.

The joining and levelling of the two adjacent half-panels of the horizontal panel 3 is carried out by means of positioning blocks 56, 57 (FIGS. 12, 13) placed perpendicular to wings 58, 59 and core 60 of U-shaped sections 61, 62. The wings 58 and 59 of the sections 61, 62 are disposed parallel to the plane of panel 3, and they are turned toward the inner opposing edges of the panel. Sections 61, 62 are welded at the ends of omega-shaped sections 63 which, for their part, terminate a short distance from the opposing edges of the panel so that the ends of wings 58, 59 are flush with those edges. Positioning blocks 56, 57 project from the edges of the half-panels a distance which is slightly less than the depth of the profiled sections 61, 62, to fit within the corresponding U-shaped profiles of the adjacent half-panel. That connection by means of sections and positioning blocks is standard for that type of material and it has already been described above with respect to juncture 34. What renders it original here is that, instead of a continuous U-shaped section along each opposing edge of the panel, there are provided plural sections 61 and 62 each of a length which corresponds to the width of the omega-shaped sections 63 so that the panel 3 is rendered flexible in a single direction only.

The handling of beams 10 requires considerable effort which may be obtained in two ways in the use of the invention.

In the first version, there is provided an adjustable, relatively strong telescopic stay (not shown) which is placed between the ground and the vicinity of articulations 13. There may be only one stay for a given coffering, and it acts on the middle part of a beam (not shown) placed parallel to the pivots or axes 13 to exert force on several articulated beams 10 at once. The stay has not been illustrated for it is easy to conceive it together with a screw-type device, a hydraulic device, or other similar device. Once the stay has exerted its force, the braces 14 and 15 are in their extended position and the small connecting rods 20 are lined up with their braces as illustrated in FIG. 11. It is sufficient to place a pin in the axially aligned holes 22 and 23. Simultaneously, there are actuated the jacks 7 and 8, which may be conventional screw-type jacks, and the tie beams 9 which separate the lower portions of the two sides 1 and 2. During the decoffering operation, after the central stay has been removed (not shown), the jacks 7, 8 are raised, and simultaneously the braces 14, 15 and tie beams 9 are shortened, to retract the whole coffering which then can be removed.

In a more elaborated version, the length of braces 14, 15, the retraction of jacks 7, 8 and the length of tie beams 9 are adjusted by means of a central control system. According to a preferred mode of operation, the control is essentially carried out by the horizontal shafts 16, 17 which are driven by the motor means referred to at the beginning of the present description.

The action on the tie beams 9 is provided by eccentrics 64 (FIGS. 9 and 10) which are mounted on shaft 16, and the peripheries of which are connected to tie beams 9. When shaft 16 is turned by a crank handle driven by a jack (not shown) it is easy to cause it to turn one quarter of a rotation. FIG. 9 illustrates eccentric 64 in a position where a tie beam 9 is extended. FIG. 10 shows eccentric 64 in a second position in which the tie beam 9 is retracted.

The one quarter of a rotation of shaft 16 is used, also, to actuate the jacks 7. As shown in FIG. 8, shaft 16 mounts a crank 65 which acts on a small connecting rod 66 secured to a part 67 disposed at the upper end of jack 7. By causing shaft 16 to turn in the direction of arrow 68, jack 7 is raised and the eccentric 64 moves from the position illustrated in FIG. 9 to that illustrated in FIG. 10. Jacks 7 and tie beams 9 are thus retracted. A similar control system connects shaft 16 to the brace 14, so as to retract it simultaneously.

A shaft 17 is placed in like manner near the bottom of side 2, and it operates jacks 8 as well as the braces 15. It is hardly necessary to provide a second series of eccentrics to operate tie beams 9. The two control systems may be synchronized, for example, by a hydraulic control system which acts on a pair of jacks, one each of which is at the bottom of each side 1 or 2.

Of course, jacks 7, 8, tie beams 9 as well as braces 14 and 15 provide for initial and independent adjustment of their lengths by forming those elements into two mating tubular parts which are screwed one into the other, as described and illustrated in FIGS. 8 and 11.

There has not been described the means which transforms the rotational motion of shaft 16 into the linear motion of brace 14 or 15, because it may be the same as one of those which have been described above, that is to say a system with a connecting rod and a crank (FIG. 8) or with an eccentric (FIGS. 9 and 10). It also could be the device illustrated in FIG. 11. It also could be a cam and follower type device which is standard in the operation of any device for the transformation of a rotational motion into an alternating longitudinal movement.

I claim:

1. Improvements in retractile tunnel type forms for poured concrete and the like having two spaced parallel vertical sides, the tops of said sides being connected by a horizontal panel deformable solely along axes parallel to the edges of the dihedrons formed by the junctions of the vertical sides and the horizontal panel, the sides being supported on the ground by jacks and wheels, comprising:

(a) plural horizontal articulated beams supporting the horizontal panel, said beams each having pivots at each end and at their mid-point to provide points of articulation, the ends of the beams being connected pivotally to the vertical sides, whereby said beams are operable to deform the panel by curving it downward and moving the edges of the dihedrons inward relative to each other, (b) braces for supporting the horizontal beams, said braces having lower ends connected to the bottom portions of the vertical sides and having upper ends connected close to the middle articulation points of the horizontal support beams, said braces being adjustable in length, (c) wheels supporting said vertical sides, said wheels having axles which are moveable axially relative to the wheels, (d) elastic means disposed on either side of the wheels which tends to restore the axles to mid position relative to the wheels, (e) plural tie beams extending between the lower portions of the sides, said tie beams being adjustable in length, (f) the axles being slidable axially relative to their wheels a distance on the order of twice the linear adjustment of the horizontal tie beams, whereby axial sliding of the wheels is prevented during adjusting of the tie beams.

2. A form such as defined in claim 1, characterized by the fact that the wheels are located inside of casings disposed adjacent to the bottoms of the vertical sides, each casing also containing a jack.

3. A form such as defined in claim 1, characterized by the fact that the articulated beams which support the horizontal panel have their three points of articulation aligned in a single plane when the panel is slightly convex upwardly and, when the panel is flat, the middle articulation point is located below the plane containing the two end points of articulation.

4. A form such as defined in claim 1, characterized by the fact that each horizontal beam which supports the horizontal panel is adjustable in length over a short distance by displacement of the pivot comprising the middle articulation point along elongated slots formed in the beam and by pivot displacement means comprising a tightener having a threaded stem engageable selectively within an opening formed in a transverse rib and a nut and lock-nut arrangement for securing the stem relative to the rib.

5. A form such as defined in claim 1, characterized by the fact that the horizontal panel is split in the middle to provide two separable adjacent half-panels and joining and levelling of the two adjacent half-panels is provided by small transverse positioning blocks disposed perpendicular to the wings and core of U-shaped sections on each half-panel, the wings of said sections being disposed parallel to the plane of the panel and extending toward the adjacent edges of the two half-panels, the ends of the wings of each U-shaped section being flush with the adjacent edge of its half-panel, said small positioning blocks projecting from the adjacent edges of the half-panels by an amount slightly less than the depth of the U-shaped sections, whereby the positioning blocks of one half-panel are engageable within the U-shaped sections of the other half-panel.

6. A form such as defined in claim 1 or 4, characterized by the fact that the horizontal beams which support the horizontal panel are linearly extensible to provide for enlargement of the panel, and the horizontal panel is split in its middle to provide two separable half-panels between which a complementary panel of selected width may be inserted.

7. A form such as defined in claim 6, characterized by the fact that each horizontal linearly extensible beam is divided into two half portions, each half portion including two small beams, bars maintaining the small beams in spaced parallel relation to each other to provide a space between the small beams for the slidable reception of a third small beam, and pins extending through holes in the three small beams to secure said beams together at selected linear lengths.

8. A form such as defined in claim 1, characterized by the fact that a central control system is provided for simultaneously modifying the lengths of the braces supporting the horizontal articulated beams, the displacement of the jacks supporting the vertical sides and the lengths of the tie beams connecting the bottom portions of the sides.

9. A form such as defined in claim 8, characterized by the fact that the central control system includes a horizontal shaft disposed adjacent the lower portion of one side of the coffering and driven by motor means to simultaneously actuate during the coffering and decoffering operations the horizontal tie beams, the jacks and the braces, each of said tie beams, jacks and braces further having individual adjustment means for initially and independently adjusting its length.

10. A form such as defined in claim 9, characterized by the fact that the individual adjustment means for adjusting the lengths of the tie beams, jacks and braces comprises two threaded tubular elements one of which is engageable threadingly within the other.

11. A form such as defined in claims 9 or 10, characterized by the fact that the motor means comprises a hydraulic jack.

12. A form such as defined in claims 9 or 10, characterized by the fact that the transformation of the rotational motion of the shaft into the linear motions of the tie beams, jacks and braces is carried out by known means of transforming rotary motion to linear motion, such as a cam-follower system, an eccentric system or a connecting rod-crank shaft system.

* * * * *

UNITED STATES PATENT OFFICE
CERTIFICATE OF CORRECTION

PATENT NO. : 4,261,542
DATED : April 14, 1981
INVENTOR(S) : Louis Lefebvre

It is certified that error appears in the above-identified patent and that said Letters Patent are hereby corrected as shown below:

ABSTRACT

Line 4, change "separated" to --supported--

Line 7, change "horizonts1" to --horizontal--

Signed and Sealed this

*Twenty-first* Day of *July 1981*

[SEAL]

*Attest:*

GERALD J. MOSSINGHOFF

*Attesting Officer*

*Commissioner of Patents and Trademarks*